US007811132B2

(12) United States Patent
Carpenter et al.

(10) Patent No.: US 7,811,132 B2
(45) Date of Patent: Oct. 12, 2010

(54) ELECTROMAGNETIC INTERFERENCE PROTECTIVE BACKSHELLS FOR CABLES

(75) Inventors: Bruce M. Carpenter, Bloomington, IN (US); William J. Fegan, Loogootee, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/469,074

(22) Filed: May 20, 2009

(65) Prior Publication Data

US 2010/0184327 A1 Jul. 22, 2010

Related U.S. Application Data

(60) Provisional application No. 61/145,399, filed on Jan. 16, 2009.

(51) Int. Cl.
*H01R 13/648* (2006.01)

(52) U.S. Cl. ..... 439/607.41

(58) Field of Classification Search ..... 439/607.41, 439/607.47, 607.45, 607.46, 607.49, 607.05, 439/607.3

See application file for complete search history.

(56) References Cited

U.S. PATENT DOCUMENTS

| | | | | |
|---|---|---|---|---|
| 3,535,676 | A | 10/1970 | Schultz, Sr. | |
| 4,444,453 | A | 4/1984 | Kirby et al. | |
| 4,457,576 | A * | 7/1984 | Cosmos et al. | 439/607.47 |
| 4,613,198 | A | 9/1986 | Selvin et al. | |
| 4,661,888 | A * | 4/1987 | Jewell et al. | 361/818 |
| 4,822,286 | A * | 4/1989 | Bianca | 439/607.45 |
| 4,963,104 | A * | 10/1990 | Dickie | 439/460 |
| 5,123,860 | A | 6/1992 | Kamei et al. | |
| 5,181,863 | A | 1/1993 | Welsh | |
| 5,295,868 | A | 3/1994 | Viaud et al. | |
| 5,342,203 | A | 8/1994 | Perretta et al. | |
| 5,401,177 | A | 3/1995 | Dutton et al. | |
| 5,468,161 | A | 11/1995 | Wright | |
| 5,508,475 | A | 4/1996 | Profiri et al. | |
| 5,540,602 | A | 7/1996 | Bell | |
| 5,975,953 | A | 11/1999 | Peterson | |
| 6,116,955 | A | 9/2000 | Lazaro, Jr. | |
| 6,155,867 | A | 12/2000 | Chou | |
| 6,280,257 | B1 | 8/2001 | North et al. | |
| 6,406,329 | B1 | 6/2002 | Lazaro, Jr. | |
| 6,576,833 | B2 * | 6/2003 | Covaro et al. | 174/359 |
| 6,616,480 | B2 | 9/2003 | Kameyama | |
| 7,124,505 | B2 | 10/2006 | Friesen et al. | |
| 2007/0021006 | A1 | 1/2007 | Kawamura et al. | |
| 2008/0113559 | A1 | 5/2008 | Hamai et al. | |

OTHER PUBLICATIONS

A2P4 Electrical Shield, Naval Air Systems Command, circa 1994, 4 pgs.

* cited by examiner

*Primary Examiner*—Phuong K Dinh
(74) *Attorney, Agent, or Firm*—Christopher A. Monsey

(57) ABSTRACT

A backshell for providing electromagnetic interference shielding between a shielded cable and an electrical connector. The backshell includes a housing defined by a first housing member coupled to a second housing member by a releasable coupler.

25 Claims, 9 Drawing Sheets

ELECTROMAGNETIC INTERFERENCE PROTECTIVE BACKSHELLS FOR CABLES

CROSS-REFERENCE TO RELATED APPLICATION

This application claims priority to U.S. Provisional Patent Application Ser. No. 61/145,399, filed Jan. 16, 2009, the disclosure of which is expressly incorporated by reference herein.

STATEMENT REGARDING FEDERALLY SPONSORED RESEARCH OR DEVELOPMENT

The invention described herein includes contributions by one or more employees of the Department of the Navy made in performance of official duties and may be manufactured, used and licensed by or for the United States Government for any governmental purpose without payment of any royalties thereon.

BACKGROUND AND SUMMARY OF THE INVENTION

The present invention relates generally to electrical connectors and, more particularly, to a backshell assembly for reducing electromagnetic interference.

Electromagnetic interference (EMI) may adversely effect the performance of electrical circuits. As such, efforts have been made to reduce the sensitivity of electrical circuits to EMI, and to reduce the levels of radiated EMI interfering with electrical circuits. For example, various shielding measures, including shielded cable couplers or backshells, have been developed to reduce EMI transmissions interfering with electrical circuits.

According to an illustrative embodiment of the present disclosure, a backshell configured to receive the end of an electromagnetic interference shielded cable includes a first housing member formed of an electrically conductive material, and a second housing member formed of an electrically conductive material. The second housing member cooperates with the first housing member to define a housing including a receiving cavity extending between opposing first and second ends. A neck is supported proximate the first end, and a connector interface is supported proximate the second end. A releasable coupler operably couples the first housing member with the second housing member. An electromagnetic interference gasket is supported by the connector interface and is configured to be in electrical communication with a cooperating electrical connector. A plurality of gripping members are supported by the neck and are configured to engage an electrically conductive cover of a cable such that the cover of the cable is in electrical communication with the housing. The neck includes a passageway in communication with the receiving cavity and is configured to receive a portion of the cable. A clamp cooperates with the gripping members of the neck to couple the cable to the housing such that a portion of the cover of the cable is captured between the clamp and the neck.

According to another illustrative embodiment of the present disclosure, a backshell configured to receive an end of an electromagnetic interference shielded cable includes a housing having a first housing member formed of an electrically conductive material, and a second housing member formed of an electrically conductive material. The second housing member cooperates with the first housing member to define a receiving cavity extending longitudinally between opposing first and second ends. A longitudinally extending neck is supported at the first end of the receiving cavity and defines a cable receiving passageway. A connector interface is supported at the second end of the receiving cavity. A releasable coupler operably couples the first housing member with the second housing member. An electromagnetic interference shield is positioned intermediate the first and second housing members to facilitate electrical conductivity therebetween. The first housing member and the second housing member are configured to be separable along at least one longitudinal plane extending through the neck for providing access to the receiving cavity and the passageway of the neck.

According to another illustrative embodiment of the present disclosure, a backshell configured to receive the end of a electromagnetic interference shielded cable includes a first housing member formed of an electrically conductive material, and a second housing member formed of an electrically conductive material. The second housing member cooperates with the first housing member along a housing interface to define a housing including a receiving cavity extending longitudinally between opposing first and second ends. The housing interface extends within a first interface plane at the first end and within a second interface plane at the second end, the first interface plane being spaced apart from the second interface plane. A releasable coupler operably couples the first housing member with the second housing member. An electromagnetic interference shield is supported by the housing interface and is configured to facilitate electrical communication between the first housing member and the second housing member. The electromagnetic interference shield includes portions extending within the first and second interface planes.

According to yet another illustrative embodiment of the present disclosure, a method of servicing an electrical connector includes the steps of providing a backshell housing having a first housing member formed of an electrically conductive material and a second housing member formed of an electrically conductive material and cooperating with the first housing member to define a receiving cavity extending between opposing first and second ends along a longitudinal axis. A neck is supported proximate the first end and extends parallel to the longitudinal axis, and a connector interface is supported proximate the second end and extends parallel to the longitudinal axis. The method further includes the steps of providing a cable including a plurality of wires and an electrically conductive cover around the plurality of wires, a first portion of the cable extending within the receiving cavity and the cover being electrically coupled to the housing. The method also includes the steps of disconnecting the electrically conductive cover from the housing, and releasing a coupler from between the first housing member and the second housing member. The method further includes the steps of separating the second housing member from the first housing member along a housing interface extending through the connector interface and the neck, and accessing the portion of the cable within the receiving cavity of the housing.

BRIEF DESCRIPTION OF THE DRAWINGS

The foregoing aspects and many of the attendant advantages of this invention will become more readily appreciated as the same become better understood by reference to the following detailed description when taken in conjunction with the accompanying drawings.

Figure 1:
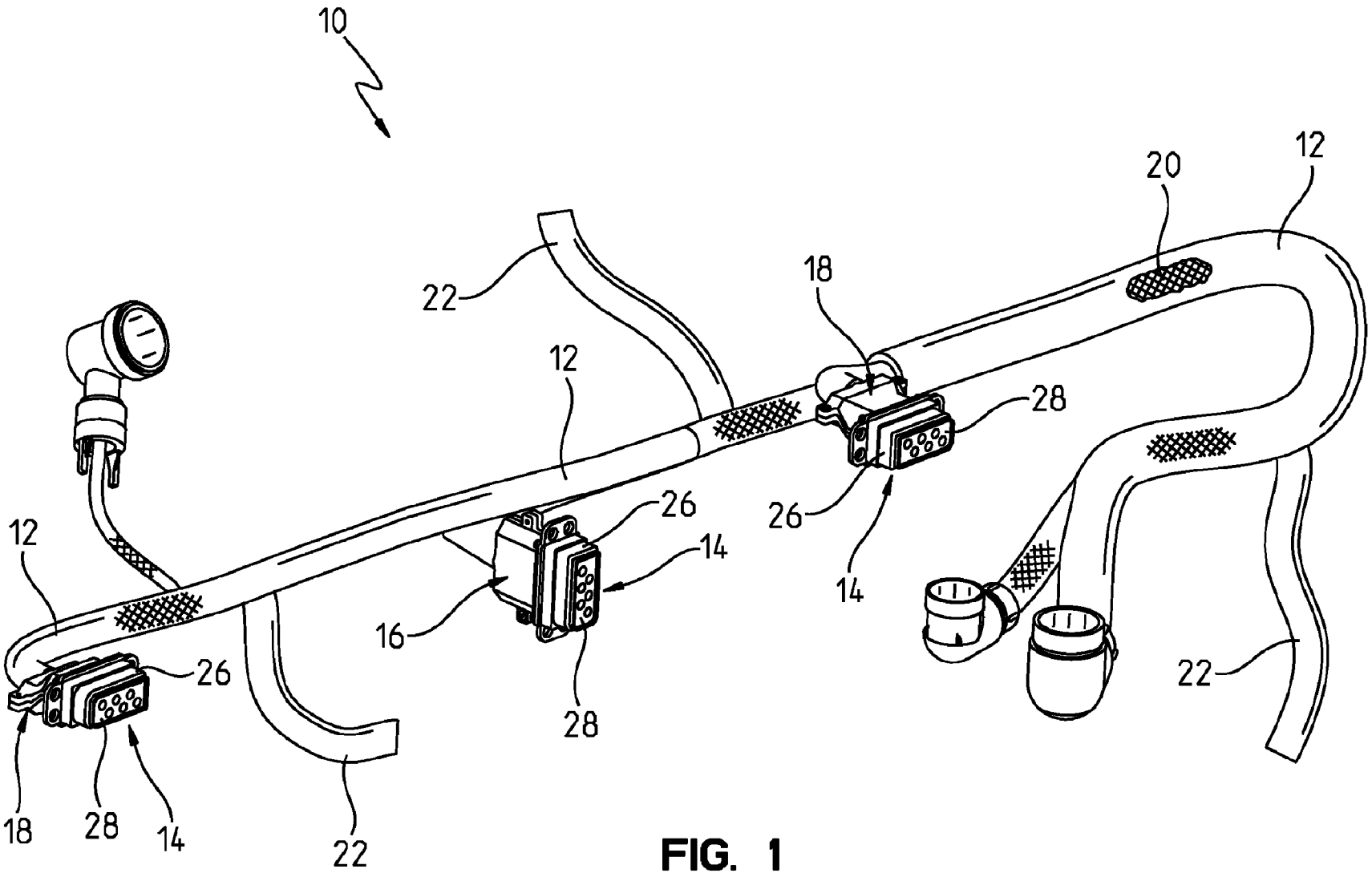
FIG. 1 is a perspective view of a wiring harness assembly including illustrative backshells according to the present disclosure.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

With reference initially to FIGS. 1-4, an illustrative wiring harness 10 is shown for providing electrical communication between various components. Such a wiring harness 10 may be used in a variety of applications, including for electrically coupling electronic components within vehicles and/or aircraft. The wiring harness 10 may include a plurality of electromagnetic interference (EMI) shielded cables 12 coupled to electrical connectors 14 through illustrative cable couplers or backshells 16 and 18 of the present disclosure. The cables 12 illustratively include an EMI shielding cover, such as an electrically conductive outer cover, illustratively overbraid 20. The overbraid 20 is illustratively electrically coupled to the backshells 16 and 18 and to grounding straps 22. The grounding straps 22 are also illustratively formed of electrically conductive material and are coupled to ground termination points (not shown), such that a grounding path is defined from the backshells 16, 18, through the overbraid 20 and grounding straps 22, to ground. The overbraid 20 and the grounding straps 22 may be formed of any conventional electrically conductive material, such as intermeshed fibers of tin-copper alloy. A protective cover 24, illustratively formed of an aromatic nylon such as Nomex (available from DuPont), may be placed over the overbraid 20 to protect against abrasion and contaminants.

Figure 3:
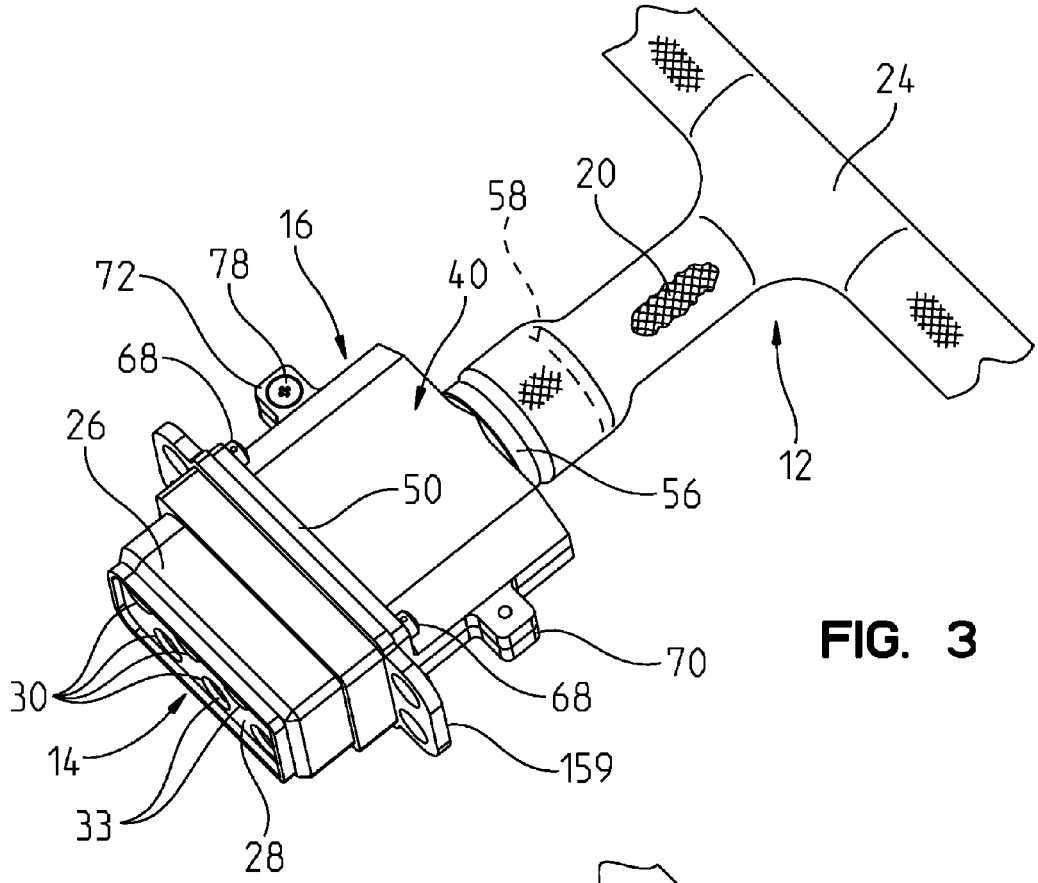
FIG. 3 is a perspective view of an illustrative backshell with a cable and a connector coupled thereto.
Figure 4:
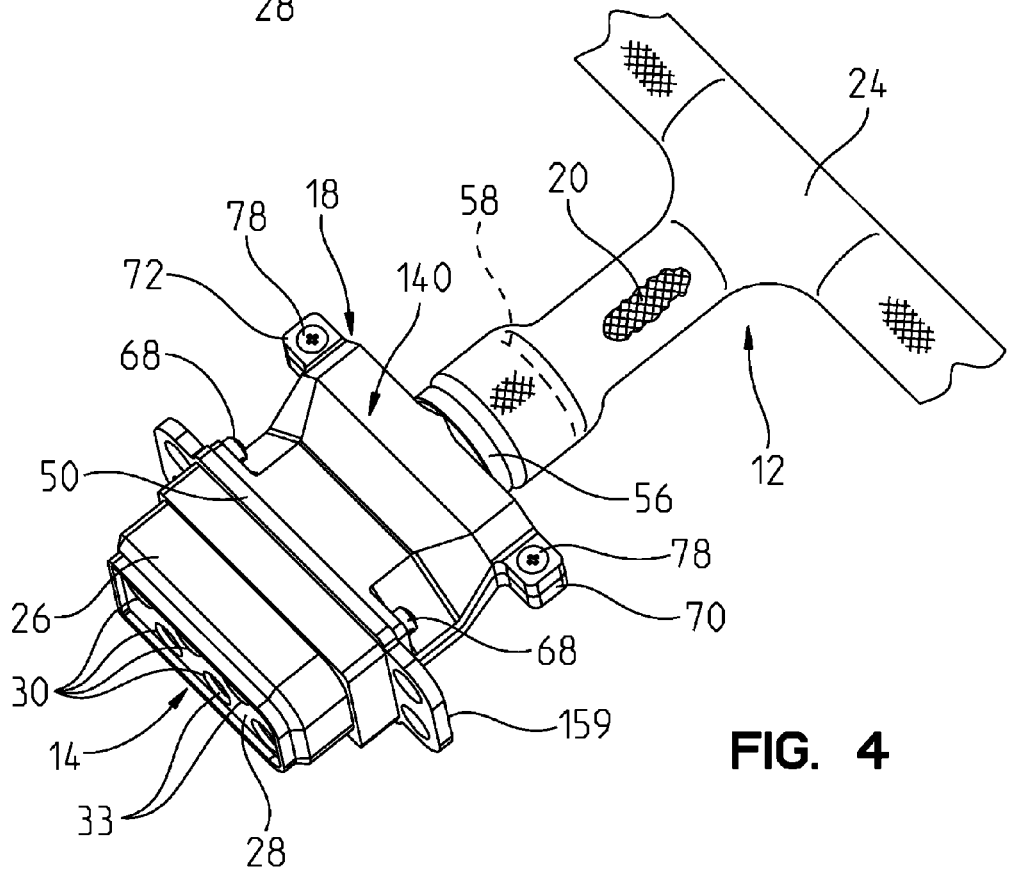
FIG. 4 is a perspective view of a further illustrative backshell with a cable and a connector coupled thereto.
Figure 5:
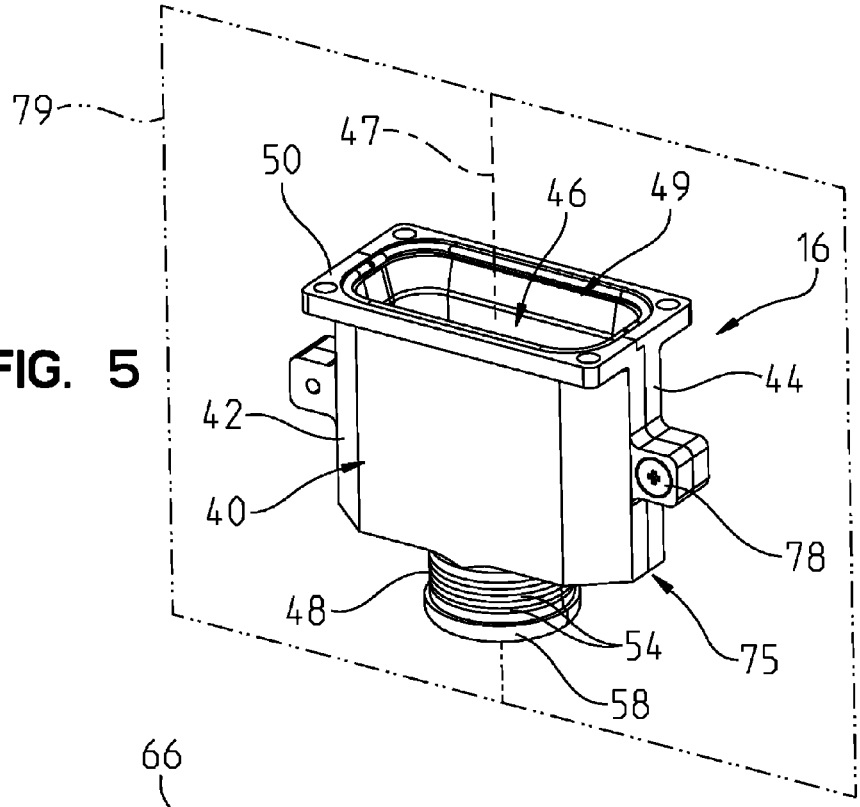
FIG. 5 is a perspective view of the backshell of FIG. 3.

The illustrative electrical connectors 14 may comprise Bendix Style 10-290928 connectors (with the associated sealing plug 990040-1 removed). With reference to FIGS. 3 and 4, the connectors 14 illustratively include a shell 26 supporting a resilient receiver or strain relief plug 28. The shell 26 may be formed of a rigid electrically conductive material, such as aluminum, while the receiver 28 may be formed of a flexible electrically insulating material, such as an elastomer. As shown in FIGS. 3, 4, 7 and 13, the receiver 28 includes a plurality of apertures 30 (illustratively six) having inner ends 31 for receiving cooperating connector pins 32 coupled to wires 34 received within an electrically insulating jacket 36 of cable 12. The connector 14 may cooperate with mating electrical contacts (not shown). More particularly, mating electrical contacts are configured to be received within outer ends 33 of apertures 30 to electrically communicate with pins 32, while the receiver 28 is configured to maintain the pins 32 in position.

Figure 2:
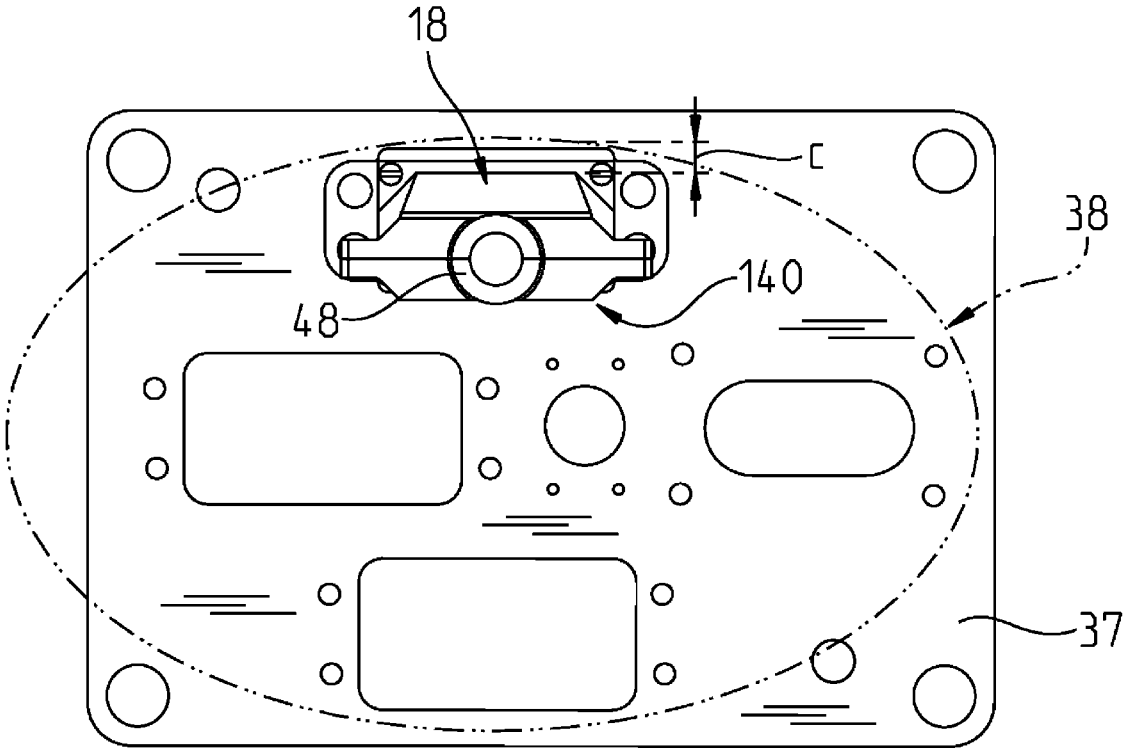
FIG. 2 is a plan view of an illustrative mounting configuration for a backshell of FIG. 1.

As shown in FIG. 2, the backshells 16 and 18 have been dimensioned to provide a predetermined clearance "c" with obstructions, such as mounting members. In one illustrative embodiment, the outer dimensions of the backshell 18 are determined by its location on a mounting member 37 (e.g., a transmitter block) relative to a hardback cutout profile 38. First illustrative backshell 16 is shown in FIG. 3, and second illustrative backshell 18 is shown in FIG. 4. With further reference to FIG. 2, the second backshell 18 is configured to provide clearance "c" of at least 0.100 inches (0.254 centimeters) with cutout profile 38 when coupled to mounting member 37. Additional variations of the backshells 16 and 18 may result from different mounting configurations and space requirements.

With reference now to FIGS. 3 and 5-7, illustrative backshell 16 (also known as a "straight backshell") includes a housing 40 defined by a first half shell or housing member 42 and a second half shell or housing member 44. The first housing member 42 and the second housing member 44 are illustratively identical to each other in order to facilitate manufacturing and reduce the number of different component parts. The first and second housing members 42 and 44 are illustratively formed of an electrically conductive material, such as aluminum.

The housing 40 defines a receiving cavity 46 extending axially along a longitudinal axis 47 between a neck 48 at a first end and a connector interface 50 at a second end. In the illustrative embodiment, the neck 48 is substantially longitudinally aligned with the connector interface 50. In other words, both the neck 48 and the connector interface 50 extend substantially parallel to the longitudinal axis 47. An inner portion of the connector receiver 28 extends beyond an opening 49 of the connector interface 50 and into the receiving cavity 46. A portion of the jacket 36 of cable 12 containing wires 34 is configured to be received within a cable receiving passageway 51 of the neck 48, while wires 34 with connector pins 32 extend into the receiving cavity 46. An outer surface 52 of the neck 48 includes a plurality of gripping members 54, illustratively annular ridges, to assist in securing EMI overbraid 20 thereto. A band clamp 56 illustratively extends around the overbraid 20 to secure the cable 12 to the neck 48. The clamp 56 may be a conventional band clamp, such as Glenair clamping band part no. 600-057-1, and secured in an annular configuration around the neck 48 such that the overbraid 20 is secured between the gripping members 54 and the clamp 56. An annular flange 58 is provided at an outer end of the neck 48 to prevent the clamp 56 from slipping off of the housing 40.

The connector interface 50 includes a flange 60 surrounding opening 49 and having a plurality of mounting apertures 62. A groove 64 is formed within the connector interface 50 and is configured to receive an EMI shield, illustratively an EMI gasket 66. The EMI gasket 66 is illustratively formed of an electrically conductive material, such as interconnected strands of Monel. Shell 26 of the connector 14 is configured to be coupled to the interface 50 through a plurality of fasteners, such as fillister head screws 68 (FIG. 3), while the EMI gasket 66 is configured to be in electrical communication with the shell 26 of the connector 14.

Figure 6:
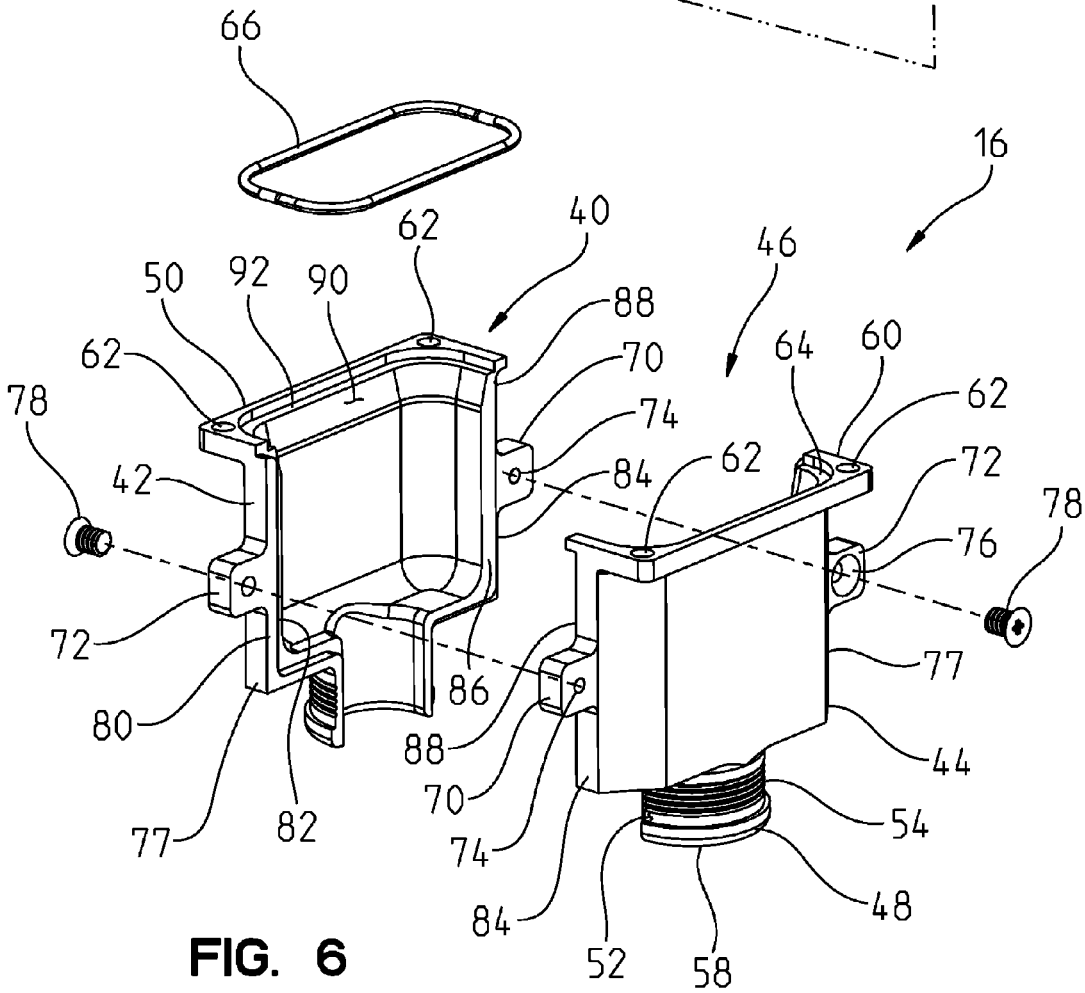
FIG. 6 is an exploded perspective view of the backshell of FIG. 5.
Figure 7:
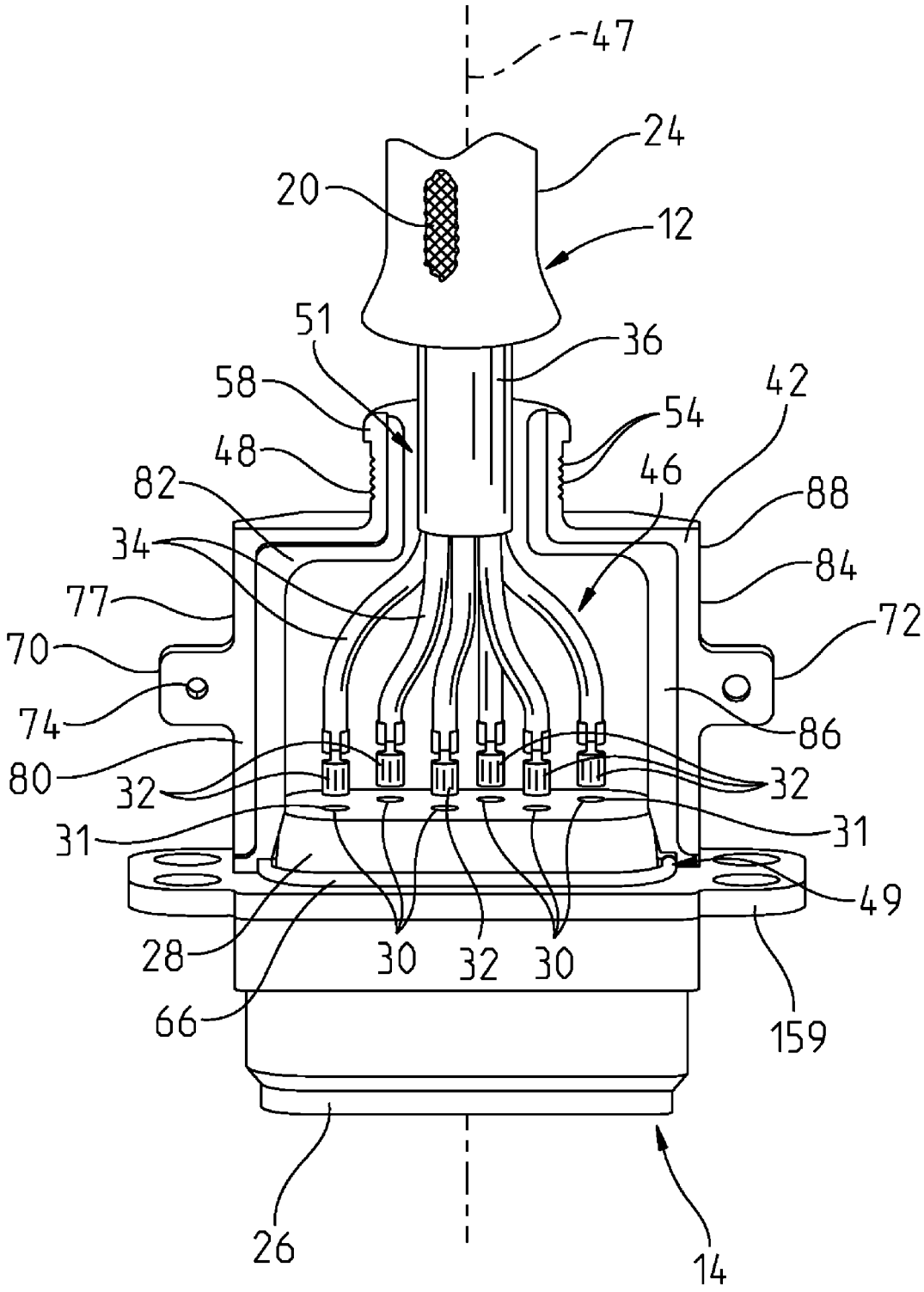
FIG. 7 is a perspective view of the illustrative backshell of FIG. 3, with the second housing member removed thereby providing access to the cable and the connector within the receiving cavity.

With reference to FIG. 6, first and second retaining bosses or ears 70 and 72 extend laterally outwardly from the housing 40 and include apertures 71 and 73 configured to receive releasable couplings, such as screws 78. The first boss 70 illustratively includes a locking member, such as a locking helicoil 74, while the second boss 72 illustratively includes a countersunk recess 76 configured to receive the head of screw 78. Each of the screws 78 is configured to cooperate with the locking helicoil 74 of the opposing housing member 42 and 44 for releasably securing the housing members 42 and 44 together.

Referring again to FIG. 5, the first and second housing member 42 and 44 are separable along a housing interface 75 positioned substantially within a longitudinal plane 79 extending laterally relative to the longitudinal axis 47 through the receiving cavity 46 and the neck 48 for providing unobstructed access to the receiving cavity 46 and the passageway 51 of the neck 48. Each of the housing members 42 and 44 include a first sidewall 77 having a tongue 80 and a groove 82, and a second sidewall 84 having a cooperating tongue 86 and a cooperating groove 88. The first sidewall 77 of each housing member 42, 44 cooperates with the second sidewall 84 of the cooperating housing member 44, 42. Given the symmetry of the housing members 42 and 44, upon assembly of the housing 40, the tongue 80 of each housing member 42, 44 is received within the groove 88 of the other housing member 44, 42. Similarly, the tongue 86 of each housing member 42, 44 is received within the groove 82 of the other housing member 44, 42. The abutting walls or tongues 88 and 86 define an electromagnetic interference shield, illustratively barrier wall 89, to prevent EMI interference with the cable 12 within receiving cavity 46. Illustratively, the EMI shield 89 is formed by the tongues 80 and 86 having a combined width of at least about 0.090 inches (about 0.229 centimeters).

As detailed above, the connector 14 includes a resilient receiver 28 including apertures 30 configured to receive the connector pins 32 of the cable 12. As the connector 14 is pushed axially inwardly into the receiving cavity 46 of housing 40, a draw angle surface 90 at the leading edge 92 of the cavity 46 forces the resilient receiver 28 inwardly (perpendicular to the longitudinal axis), thereby compressing the apertures 30 around the connector pins 32. As such, the interface between the connector 14 and the receiving cavity 46 provides a strain relief by preventing inadvertent removal of the connector pins 32 from the apertures 30 of the receiver 28.

With reference now to FIGS. 8-13, a further illustrative backshell 18 (also known as a "joggled backshell") is shown as including a housing 140 defined by a first housing member 142 and a second housing member 144. The first and second housing members 142 and 144 are illustratively formed of an electrically conductive material, such as aluminum. Many of the features of the backshell 18 are similar to backshell 16 of FIGS. 5-7. As such, like reference numbers are used to identify like components.

Figure 8:
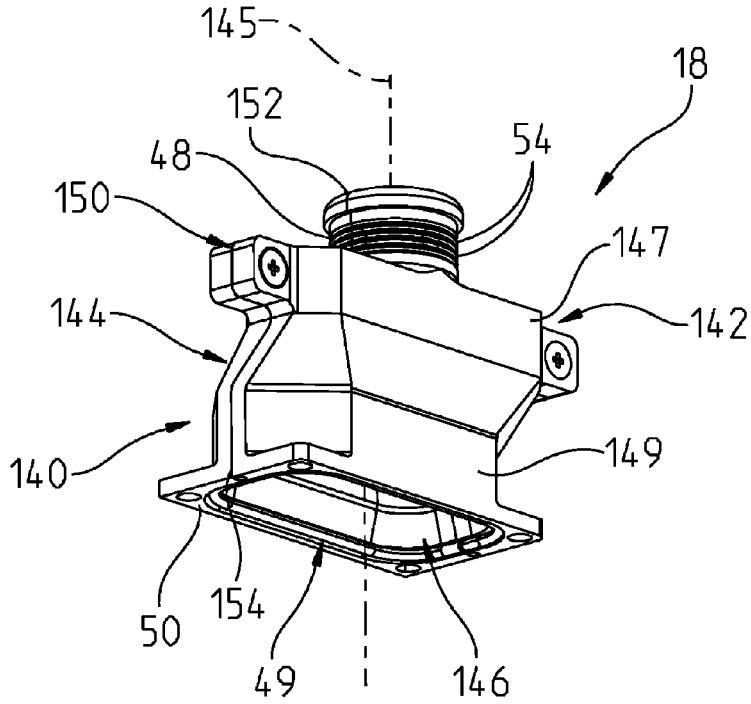
FIG. 8 is a perspective view of the backshell of FIG. 4.
Figure 9:
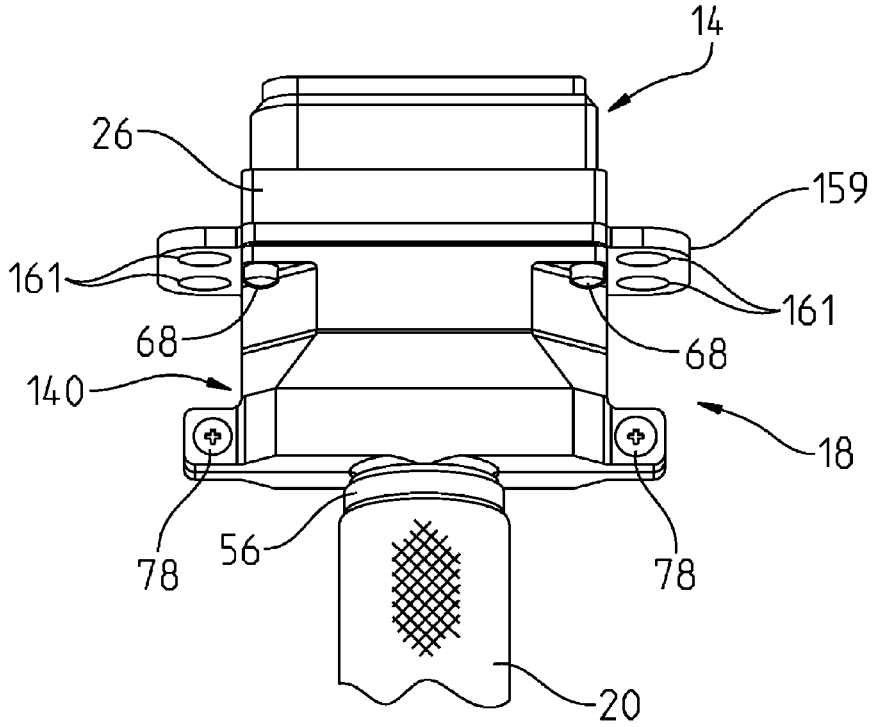
FIG. 9 is a perspective view of the backshell of FIG. 8, showing a cable and a connector coupled thereto.
Figure 12:
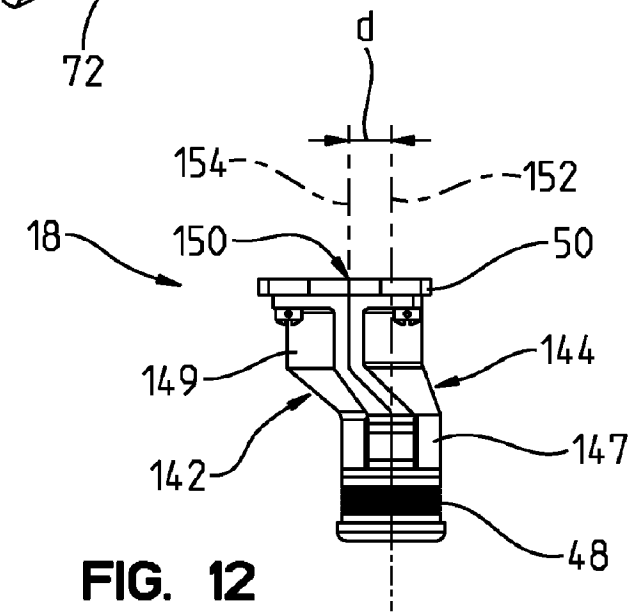
FIG. 12 is a side elevational view of the backshell of FIG. 8.
Figure 13:
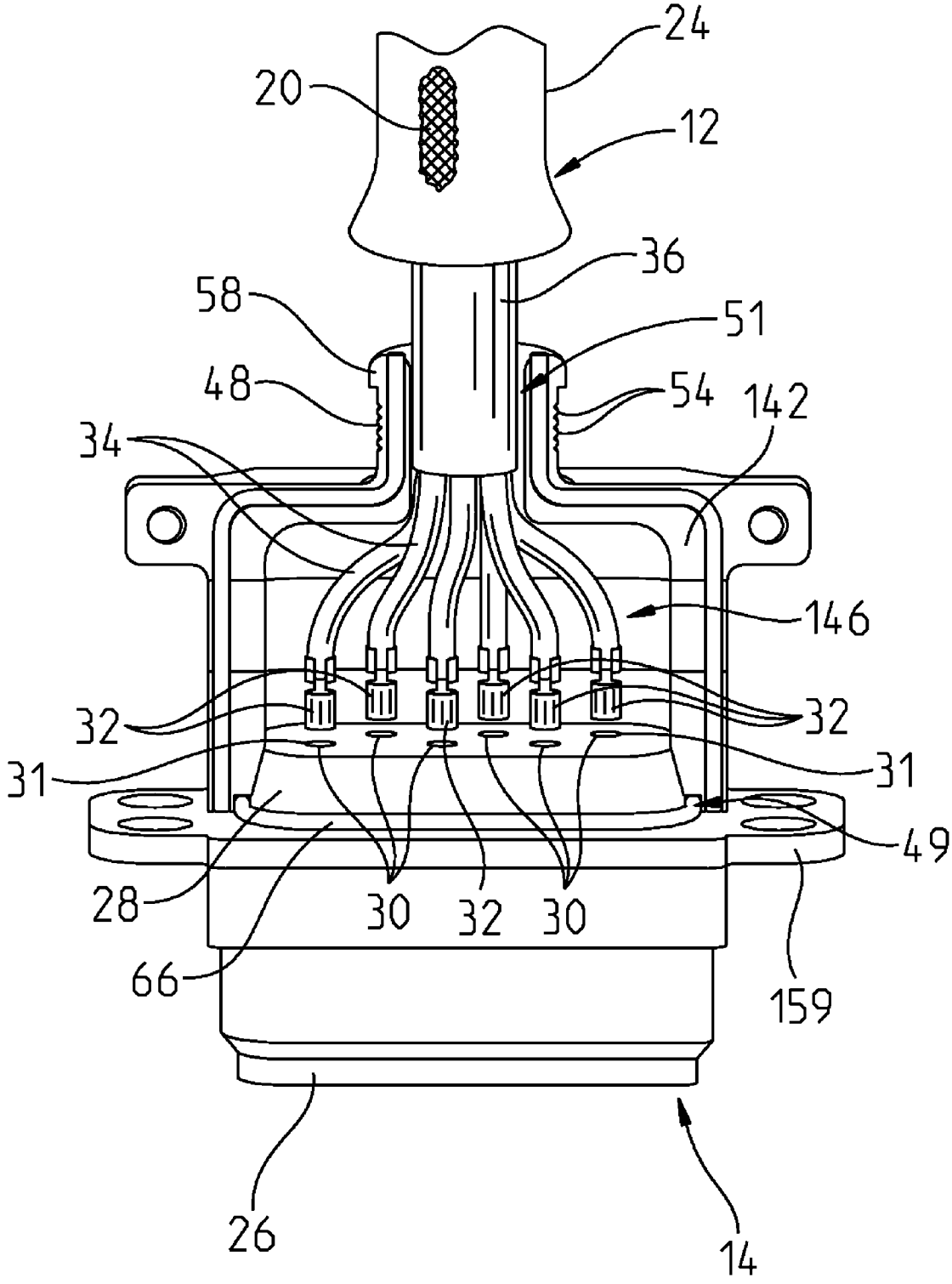
FIG. 13 is a perspective view of the illustrative backshell of FIG. 8, with the second housing member removed thereby providing access to the cable and the connector within the receiving cavity.

A receiving cavity 146 extends axially parallel to a longitudinal axis 145 between neck 48 and connector interface 50. With reference to FIGS. 8 and 12, the housing 140 includes a first portion 147 supporting neck 48 and a second portion 149 supporting connector interface 50. With reference to FIG. 12, the first portion 147 is longitudinally offset from the second portion 149. In other words, the first and second housing members 142 and 144 are separable along an offset or joggled housing interface 150 including a first interface plane 152 and a second interface plane 154. The first interface plane 152 is spaced apart from the second interface plane 154 by a distance "d". In one illustrative embodiment, the distance "d" is equal to about 0.300 inches (about 0.762 centimeters). The first interface plane 152 extends through the first portion 147 including neck 48 for providing access to the passageway of the neck 48, while the second interface plane 154 extends through the second portion 149 for providing access to the receiving cavity 146. Such a longitudinal offset of housing portions 147 and 149 is advantageous in certain mounting situations involving limited space, such as those illustrated in FIG. 2.

Figure 10:
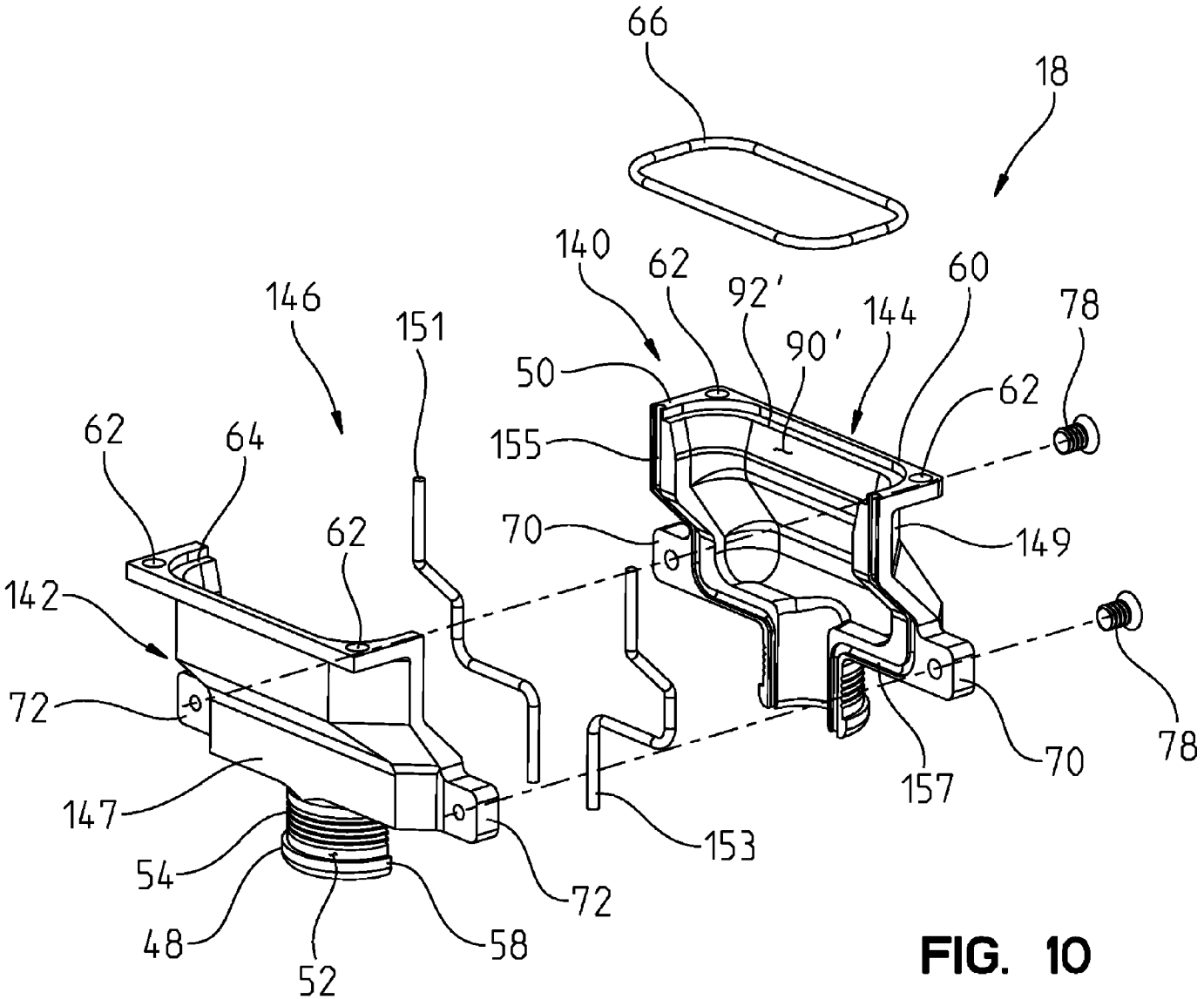
FIG. 10 is a front exploded perspective view of the backshell of FIG. 8.
Figure 11:
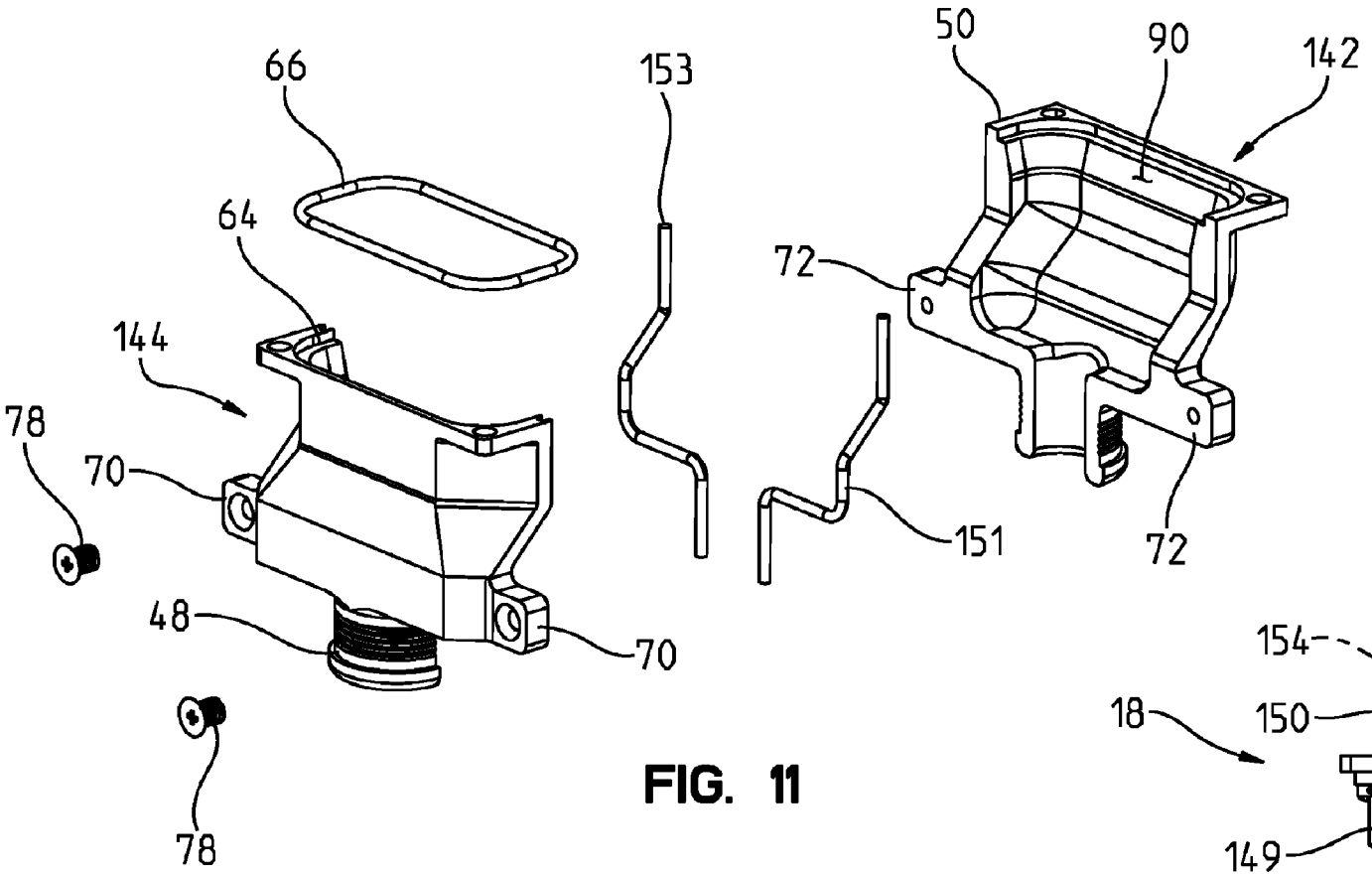
FIG. 11 is a rear exploded perspective view of the backshell of FIG. 8.

Given the offset or joggled configuration of the housing 140 and limited space for an EMI barrier wall, the overlapping wall 89 of backshell 16 is replaced with respective electromagnetic interface gaskets 151 and 153 (FIGS. 10 and 11). More particularly, each housing member 142 and 144 defines a seat, illustratively a groove 155, 157, to receive respective EMI gasket 151, 153 extending from the neck 48 to the connector interface 50. As shown in FIGS. 10-12, the EMI gaskets 151 and 153 generally follow the contour of the housing interface 150 and, as such, include portions extending within both interface planes 152 and 154.

As further detailed herein, the backshells 16 and 18 are configured to fit within environmental constraints when assembled per wiring requirements. The backshells 16 and 18 illustratively mate to conventional electrical connectors 14, after the respective sealing plug has been removed. The preexisting fasteners 68 used to hold sealing plug are used to attach connector 14 to respective backshell 16, 18. Once the backshell 16, 18 is attached to cable 12, EMI overbraid 20 is slipped over the neck 48 of the respective backshell 16, 18 and secured via band clamp 56.

Each backshell 16, 18 may be coupled to the cable 12 as either a half shell or a completed assembly. According to one illustrative method of assembly, the first housing member 42, 142 is separate from the second housing member 44, 144 as the connector pins 32 of cable 12 are received within inner ends 31 of apertures 32 of receiver 28. The assembled receiver 28 and cable 12 is then placed within the receiving cavity 46 and the passageway 51 of the neck 48, respectively. More particularly, the conductive overbraid 20 of the cable 12 is pulled back beyond the flange 58 of the neck 48, and the cable jacket 36 placed within passageway 51. The wires 34 are positioned within the receiving cavity 46, with the connector pins 32 received within inner ends 31 of apertures 30 of receiver 28. Next, the second housing member 44, 144 is coupled to the first housing member 42, 142, illustratively by using screws 78. An EMI barrier shield is defined by overlapping wall 89 in backshell 16 and by EMI gaskets 151 and 153 in backshell 18.

Next, the shell 26 of the connector 14 is coupled to the assembled backshell housing 40, 140, illustratively through screws 68. Next, the conductive overbraid 20 of the cable 12 is pulled over the neck 48. The band clamp 56 is secured around the overbraid 20, such that the overbraid 20 is received intermediate the clamp 56 and the gripping members 54.

The releasable couplers or screws 78 between the housing members 42 and 44, 142 and 144 facilitate disassembly for servicing and repair. Moreover, the structure of the backshells 16 and 18 allows for quick separation of respective housing members 42, 44 and 142, 144 for inspection and repair of internal components within receiving cavity 46, 146 and neck passageway 51. A user may pull back the EMI overbraid 20 so that conductor level visual inspection can be performed without de-pinning the connector 14. Cable assemblers illustratively clamp the housing members 42, 142 and 44, 144 to the cable 12 prior to drawing the receiver 28 into the draw angle surface 90 of cavity 46, 146 of the backshell 16, 18. More particularly, the screws 68 are illustratively used to couple receiver 28 to backshell 16, 18. The connector flange 159 has a plurality of apertures 161 which may be used to secure the connector 14 to a connector support via a conventional spring loaded mounting assembly and screw combination (not shown).

An illustrative method of servicing the electrical connector 14 includes providing the backshell housing 40, 140 with cable 12 including jacket 36 extending within the receiving cavity 46, 146 and overbraid 20 electrically coupled to the housing 40, 140. The overbraid 20 is uncoupled from the neck 48 by removing the clamp 56 and sliding the overbraid 20 axially away from the housing 40, 140. Next, the screws 68 are released from between at least the second housing member 44, 144 (and optionally the first housing member 42, 142) and the shell 26 of the connector 14. Second housing member 44, 144 is then uncoupled from the first housing member 42, 142 by releasing screws 78. The second housing member 44, 144 is then separated from the first housing member 42, 142 along the housing interface 75, 150, to access a portion of the cable 12 within the receiving cavity 46, 146 of the housing 40, 140. Depending on the extent of service required, the connector pins 32 may be removed from the receiver 28. As detailed above, by providing a draw angle surface 90 on the second end of the receiving cavity 46, 146, and inserting connector pins 32 within the openings 30 of the receiver 28, upon assembly the draw angle surface 90 forces the resilient receiver 28 of the connector 14 inwardly to compress around the connector pins 32 of the cable 12.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A backshell configured to receive the end of an electromagnetic interference shielded cable, the backshell comprising:

a first housing member formed of an electrically conductive material;

a second housing member formed of an electrically conductive material, the second housing member cooperating with the first housing member to define a housing including a receiving cavity extending between opposing first and second ends, a neck supported proximate the first end, and a connector interface supported proximate the second end;

a releasable coupler operably coupling the first housing member with the second housing member;

an electromagnetic interference gasket supported by the connector interface and configured to be in electrical communication with a cooperating electrical connector;

a plurality of gripping members supported by the neck and configured to engage an electrically conductive cover of a cable such that the cover of the cable is in electrical communication with the housing, the neck including a passageway in communication with the receiving cavity and configured to receive a portion of the cable; and a clamp cooperating with the gripping members of the neck to couple the cable to the housing such that a portion of the cover of the cable is captured between the clamp and the neck;

wherein the second housing member is separable from the first housing member along a housing interface, the housing interface extending within a first interface plane at the first end and within a second interface plane at the second end, the first interface plane being spaced apart from the second interface plane.

2. The backshell of claim 1, wherein each of the first and second housing members include a tongue and a groove, the tongue received within the groove of the other of the second and first housing member to define an electromagnetic interference barrier wall.

3. The backshell of claim 2, wherein the electromagnetic interference barrier wall extends from the neck to the electromagnetic interference gasket at the connector interface.

4. The backshell of claim 1, wherein the first and second housing members define a gasket seat, and an electromagnetic interference gasket is supported by the gasket seat from the neck to the connector interface.

5. The backshell of claim 1, wherein the gripping members include a plurality of annular ridges configured to engage an electromagnetic interference braiding.

6. The backshell of claim 1, wherein the coupler includes a releasable fastener extending between mounting apertures within the first and second housings.

7. The backshell of claim 1, wherein the electromagnetic interference gasket supported by the connector interface comprises a closed loop electrically conductive gasket.

8. The backshell of claim 1, wherein the first housing member and the second housing member are configured to be separable along at least one longitudinal plane extending through the neck for providing access to the receiving cavity and the passageway of the neck.

9. A backshell configured to receive the end of an electromagnetic interference shielded cable, the backshell comprising:

a first housing member formed of an electrically conductive material;

a second housing member formed of an electrically conductive material, the second housing member cooperating with the first housing member to define a housing including a receiving cavity extending between opposing first and second ends, a neck supported proximate the first end, and a connector interface supported proximate the second end;

a releasable coupler operably coupling the first housing member with the second housing member;

an electromagnetic interference gasket supported by the connector interface and configured to be in electrical communication with a cooperating electrical connector;

a plurality of gripping members supported by the neck and configured to engage an electrically conductive cover of a cable such that the cover of the cable is in electrical communication with the housing, the neck including a passageway in communication with the receiving cavity and configured to receive a portion of the cable; and a clamp cooperating with the gripping members of the neck to couple the cable to the housing such that a portion of the cover of the cable is captured between the clamp and the neck;

further including a draw angle surface at the second end of the receiving cavity, wherein a connector including a resilient receiver is configured to cooperate with the connector interface, the cable includes a plurality of connector pins, and the draw angle surface is configured to force the resilient receiver of the connector inwardly to compress around the connector pins of the cable.

10. A backshell configured to receive the end of an electromagnetic interference shielded cable, the backshell comprising:

a housing including a first housing member formed of an electrically conductive material, and a second housing member formed of an electrically conductive material, the second housing member cooperating with the first housing member to define a receiving cavity extending longitudinally between opposing first and second ends, a longitudinally extending neck supported at the first end of the receiving cavity and defining a cable receiving passageway, and a connector interface supported at the second end of the receiving cavity;

a releasable coupler operably coupling the first housing member with the second housing member;

an electromagnetic interference shield positioned intermediate the first and second housing members to facilitate electrical conductivity therebetween; and wherein the first housing member and the second housing member are configured to be separable along at least one longitudinal plane extending through the neck for providing access to the receiving cavity and the passageway of the neck;

wherein the second housing member is separable from the first housing member along a housing interface, the housing interface extending within a first interface plane at the first end and within a second interface plane at the second end, the first interface plane being spaced apart from the second interface plane.

11. The backshell of claim 10, further comprising a plurality of gripping members supported by the neck and configured to engage an electrically conductive cover of a cable received within the passageway of the neck such that the cover of the cable is in electrical communication with the housing, and a clamp cooperating with the gripping members of the neck to couple the cable to the housing.

12. The backshell of claim 10, further comprising an electromagnetic interference gasket supported by the connector interface and configured to be in electrical communication with a cooperating electrical connector.

13. The backshell of claim 10, wherein the electromagnetic interference shield includes a tongue and a groove supported by each of the first and second housing members, the tongue of each of the first and second housing members received within the groove of the other of the second and first housing member to define an electromagnetic interference barrier wall.

14. The backshell of claim 13, wherein the electromagnetic interference barrier wall extends from the neck to the connector interface.

15. The backshell of claim 10, wherein the first and second housing members define a gasket seat, and the electromagnetic interference shield comprises an electromagnetic interference gasket supported by the gasket seat from the neck to the connector interface.

16. The backshell of claim 10, wherein the coupler includes a releasable fastener extending between mounting apertures within the first and second housings.

17. A backshell configured to receive the end of an electromagnetic interference shielded cable, the backshell comprising:

a housing including a first housing member formed of an electrically conductive material, and a second housing member formed of an electrically conductive material, the second housing member cooperating with the first housing member to define a receiving cavity extending longitudinally between opposing first and second ends, a longitudinally extending neck supported at the first end of the receiving cavity and defining a cable receiving passageway, and a connector interface supported at the second end of the receiving cavity;

a releasable coupler operably coupling the first housing member with the second housing member;

an electromagnetic interference shield positioned intermediate the first and second housing members to facilitate electrical conductivity therebetween;

wherein the first housing member and the second housing member are configured to be separable along at least one longitudinal plane extending through the neck for providing access to the receiving cavity and the passageway of the neck; and further including a draw angle surface at the second end of the receiving cavity, wherein a connector including a resilient receiver is configured to cooperate with the connector interface, the cable includes a plurality of connector pins, and the draw angle surface is configured to force the resilient receiver of the connector inwardly to compress around the connector pins of the cable.

18. A backshell configured to receive the end of a electromagnetic interference shielded cable, the backshell comprising:

a first housing member formed of an electrically conductive material;

a second housing member formed of an electrically conductive material, the second housing member cooperating with the first housing member along a housing interface to define a housing including a receiving cavity extending longitudinally between opposing first and second ends, the housing interface extending within a first interface plane at the first end and within a second interface plane at the second end, the first interface plane being spaced apart from the second interface plane;

a releasable coupler operably coupling the first housing member with the second housing member;

an electromagnetic interference shield supported by the housing interface and configured to facilitate electrical communication between the first housing member and the second housing member, the electromagnetic interference shield including portions extending within the first and second interface planes; and further including a draw angle surface at the second end of the receiving cavity, wherein a connector including a resilient receiver is configured to cooperate with the housing, the cable includes a plurality of connector pins, and the draw angle surface is configured to force the resilient receiver of the connector inwardly to compress around the connector pins of the cable.

19. The backshell of claim 18, further comprising a neck supported at the first end of the housing and including a passageway in communication with the receiving cavity and configured to receive a portion of a cable, and a connector interface supported proximate the second end of the housing, wherein the first interface plane extends through the neck for providing access to the passageway of the neck.

20. The backshell of claim 19, further comprising a plurality of gripping members supported by the neck and configured to engage an electrically conductive cover of the cable such that the cover of the cable is in electrical communication with the housing.

21. The backshell of claim 19, further comprising an electromagnetic interference gasket supported by the connector interface and configured to be in electrical communication with a cooperating electrical connector.

22. The backshell of claim 19, wherein the electromagnetic interference shield includes a tongue and a groove supported by each of the first and second housing members, the tongue of each of the first and second housing members received within the groove of the other of the second and first housing member to define an electromagnetic interference barrier wall.

23. The backshell of claim 22, wherein the electromagnetic interference barrier wall extends from the neck to the connector interface.

24. The backshell of claim 19, wherein the first and second housing members define a gasket seat, and the electromagnetic interference shield comprises an electromagnetic interference gasket supported by the gasket seat from the neck to the connector interface.

25. The backshell of claim 18, wherein the coupler includes a releasable fastener extending between mounting apertures within the first and second housings.

* * * * *